United States Patent [19]

Reinhall

[11] Patent Number: 4,955,549

[45] Date of Patent: Sep. 11, 1990

[54] APPARATUS FOR TREATMENT OF FIBRE SUSPENSIONS

[75] Inventor: Rolf B. Reinhall, Belleveu, Wash.

[73] Assignee: Sunds Defibrator Aktiebolag, Sweden

[21] Appl. No.: 303,665

[22] PCT Filed: Jul. 20, 1987

[86] PCT No.: PCT/SE87/00341

§ 371 Date: Jan. 23, 1989

§ 102(e) Date: Jan. 23, 1989

[87] PCT Pub. No.: WO88/00992

PCT Pub. Date: Feb. 11, 1988

[30] Foreign Application Priority Data

Aug. 7, 1986 [SE] Sweden ..... 8603346

[51] Int. Cl.[5] ..... B02C 19/00

[52] U.S. Cl. ..... 241/80; 241/89.3; 241/259.1; 241/261.1

[58] Field of Search ..... 241/80, 97, 21, 93, 241/28, 37, 261.1, 86.1, 261.2, 261.3, 89.3, 259.1, 259.2

[56] References Cited

U.S. PATENT DOCUMENTS

| | | | |
|---|---|---|---|
| 1,939,747 | 12/1933 | Wiener . | |
| 2,741,954 | 4/1956 | Allibe | 241/89.3 |
| 2,980,350 | 4/1961 | Lejeune | 241/261.1 X |
| 3,790,092 | 2/1974 | Reinhall | 241/259.1 X |
| 4,283,016 | 8/1981 | Reinhall | 241/259.2 X |

FOREIGN PATENT DOCUMENTS

| | | |
|---|---|---|
| 438247 | 4/1925 | Fed. Rep. of Germany . |
| 2611886 | 9/1977 | Fed. Rep. of Germany . |
| 86309 | 3/1936 | Sweden . |
| 134912 | 3/1952 | Sweden . |
| 183750 | 3/1963 | Sweden . |
| 214707 | 8/1967 | Sweden . |
| 441758 | 11/1985 | Sweden . |

*Primary Examiner*—Mark Rosenbaum

*Attorney, Agent, or Firm*—Lerner, David, Littenberg, Krumholz & Mentlik

[57] ABSTRACT

An apparatus is provided for treating a fibre suspension by screening and fibre-separating mechanical working in the manufacture of papermaking pulp. The apparatus is provided with a rotor arranged within a housing, which rotor is surrounded by a stator. The inner surface of the stator cooperates with the outer surface of the rotor to define a refining gap for the treatment of the fibre suspension. The refining gap is divided into a first treating zone and a second treating zone for the processing of the fibre suspension. An adjustment member allows for adjusting the width of the refining gap within the first treating zone independently of the width of the refining gap within the second treating zone. The refining gap within both the first and second treating zones may be simultaneously adjusted by axial displacement of the rotor.

15 Claims, 3 Drawing Sheets

APPARATUS FOR TREATMENT OF FIBRE SUSPENSIONS

BACKGROUND OF THE INVENTION

This invention relates to an apparatus for treating fibre suspensions by screening (centrifugal screening) and fibre-separating mechanical working (refining), for example in water, air or steam, for the manufacture of papermaking pulp. The treatment has the object to clean the suspension by screening of enclosed coarse particles, as for example fibres not sufficiently separated, fibre bundles (shives), and to subject the coarse fraction to a fibre-separating mechanical treatment, by which this fraction is converted to dimensions acceptable in the cleaned fraction.

The present state of art has solved the screening problem by using separate screening devices and connected thereto separate devices for the treatment of the separated coarse reject fraction. This combination, however, involves the problem that available screening devices require for optimum function a very low fibre/-water concentration (normally 1–4%), while the beating devices require for optimum development of strength and quality a much higher concentration (normally 10–30%). This necessitates expensive dewatering devices between screening and reject treatment and consequently much space-requiring storage containers and extensive pump work.

SUMMARY OF THE INVENTION

The present invention eliminates these problems by combining the screening device with the refining device, which during the passage of the fibre suspension over the screen surface continuously carries out an adjustable selective refining work on the coarse fibre fraction thereby separated.

The invention, thus, renders it possible that the fibre suspension can be processed further without fibres already sufficiently treated being subjected to additional undesirable energy-requiring treatment, and that at the same time the fibre concentration in the refining/-screening device can be maintained at a high level and thereby permits optimum strength-increasing treatment of separated coarse fibre bundles (reject).

By carrying out the mechanical treatment on the inside of a cylindric or conic rotation body at relatively high rotation speed and by utilizing the intensive fluidization resulting from the refining of the reject, while at the same time the centrifugal force generated at the rotation acts substantially in perpendicular direction to apertures or slits in the screen/refining surface, the screening can be performed effectively at the higher concentration required for optimum effective treatment of the separated fraction (reject).

By using an apparatus according to the invention, the treatment can be carried out in direct connection to a so-called thermomechanical pulp manufacture where the fibre pulp produced is obtained in steam suspension. The fibre suspension can be screened and processed in steam phase at concentrations up to those resulting from the pulp manufacturing process (50% or higher).

This processing can also suitably be combined with an additional final treatment of the entire pulp flow for increasing the strength and quality, whereby fibres completely worked during the refining continuously are discharged as accept. According to the invention, the requirement of separate screening systems and separate reject treatment, including dewatering devices, storage containers with pumps and piping etc., is entirely eliminated.

BRIEF DESCRIPTION OF THE DRAWINGS

In the following, some embodiments of the invention are described in greater detail, with reference to the accompanying drawings, in which.

DETAILED DESCRIPTION

Figure 1:
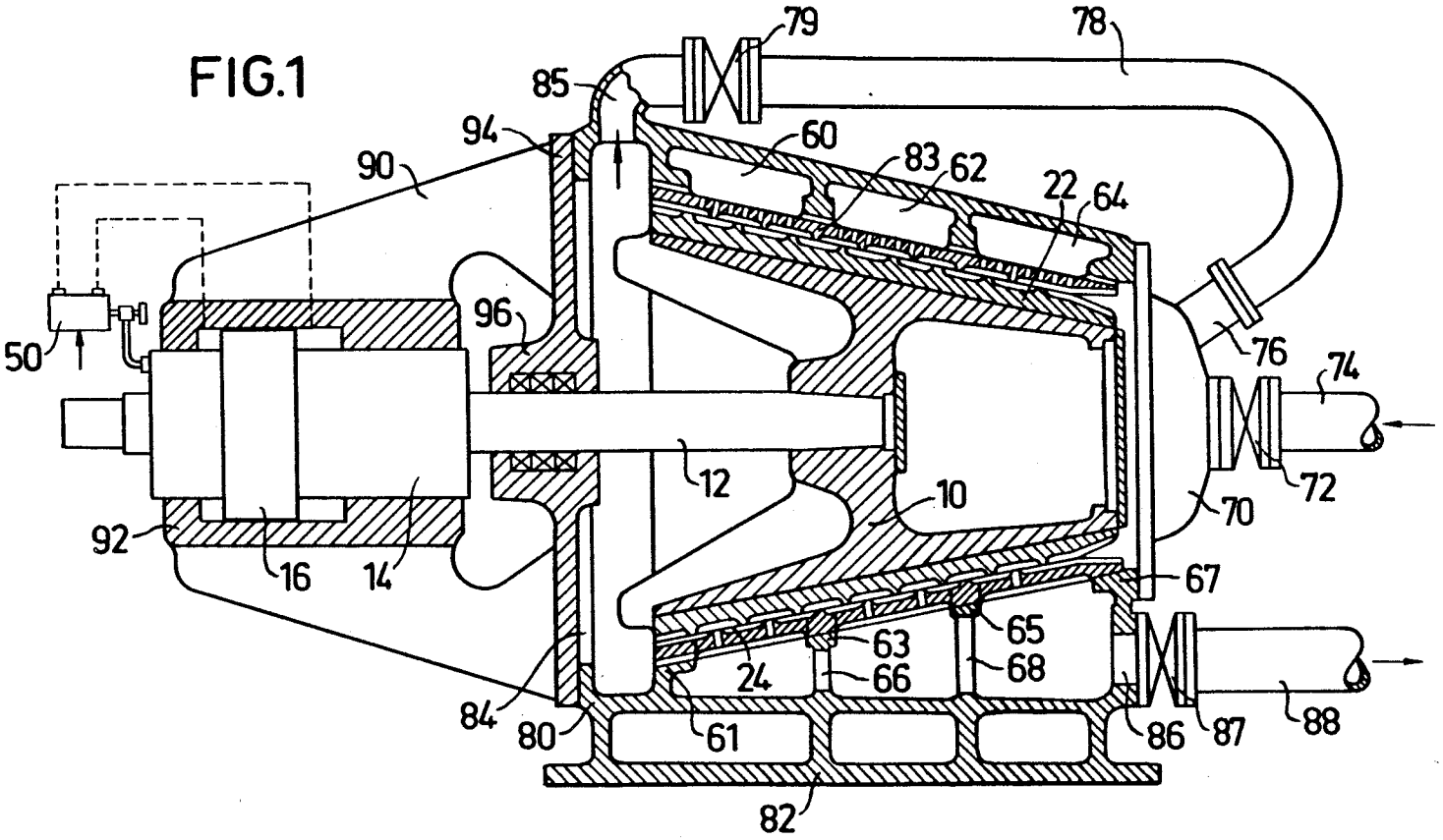
FIG. 1 is an axial cross-section of the apparatus.
Figure 3:
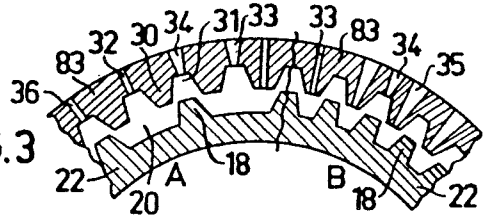
FIGS. 3–6 show different embodiments and combination of refining/screening surface and rotor device.
Figure 4:
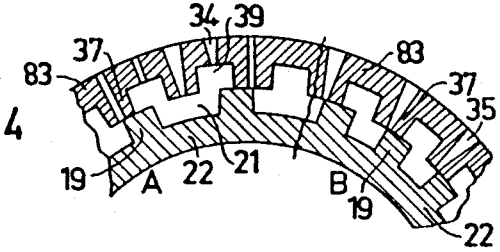
Figure 5:
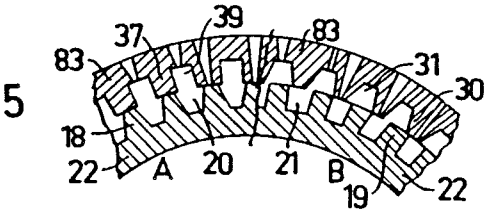
Figure 6:
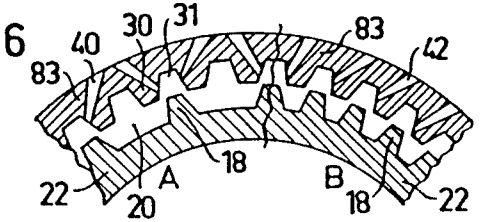
Figure 2:
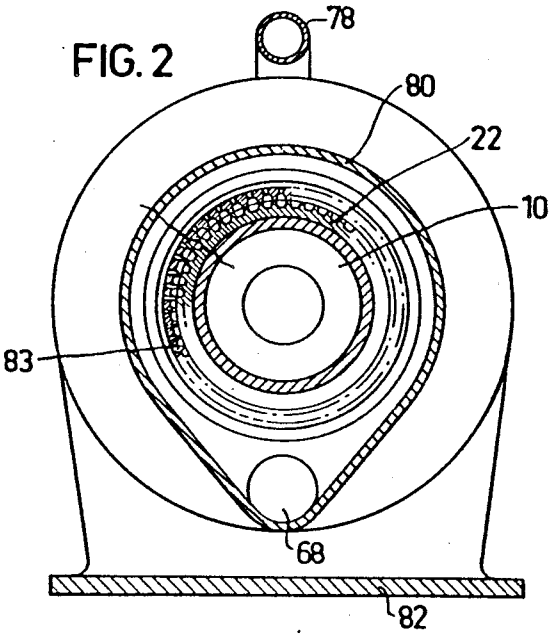
FIG. 2 is a radial cross-section of the apparatus.

A refining/screening device according to the invention comprises a rotor 10 supported on a shaft 12, which is mounted rotatably in a bearing housing 14. Said bearing housing is axially displaceable by means of a piston 16 attached thereon, which piston is enclosed by a combined cylinder and bearing bracket 92, which in its turn is supported by a yoke 90 with a sealing plane end wall 94. This end wall also supports a packing box 96, by which the shaft 12 extends air-tight through the end wall 94.

The bearing bracket 92 with yoke 90 is connected air-tight through the end wall 94 to a housing 80 enclosing the machine and combined with a stand 82 supporting the machine.

The interior of the housing 80 is designed as a truncated cone with two openings, the greater one 84 of which is connected to the end wall 94, and the smaller one to a curved end wall 70, which supports a feed line 74 with a control valve 72.

The housing 80 is provided with two outlet openings. One opening 85 at the greater diameter of the housing is connected to a return line 78 with control valve 79. The return line 78 is connected to the inlet end of the apparatus via the pipe socket 76. An opening 86 at the smaller diameter of the housing is connected to an outlet pipe 88 via a control valve 87.

The rotor 10 supports refining and fluidization devices 22, which are attached to the rotor by bolt or key connection.

The conical inner surface of the housing is formed of four annular supports 61,63,65,67, which carry a stator 83 comprising combined refining and screening devices, which also are attached by means of bolt or key connections. The rotor 10 and stator 83 define a gap 24 between themselves.

The outer volume of the housing 80 is divided by the stator 83 and the annular supports 61,63,65,67 into three annular chambers 60,62,64, which in their lower portions communicate with the outlet opening 86 by means of the openings 66,68.

The space of the housing inside the stator communicates at the feed end via the end wall 70 with the feed line 74 and return line 78,76, and at the outlet end of the rotor with the opening 85 and return line 78.

The refining and fluidization devices 22 of the rotor 10 are designed with bars 18,19 and grooves 20,21, which can vary both in division and configuration. Some examples are shown in FIGS. 3,4,5,6. The longitudinal direction of the grooves can coincide with the generatrix of the cone or be angled therefrom both in and against the rotation direction, whereby the pumping action of the rotor in axial direction can be increased or reduced. The bars 18,19 extend at least along a portion of the rotor 10 and gap 24. According to the embodiment shown, the bars extend along the entire gap 24.

The stator 83 is provided with bars 30,37 and grooves 31, 39, which also can be designed with different division and configuration. Some examples are shown in FIGS. 3,4,5,6. The stator further is provided with perforations 32–35, 40,42 either round or slit-shaped, preferably with widening area in the direction from the rotor 10 to the space 60,62,64. Some examples are shown in FIGS. 3,4,5,6. The bars 30,37 of the stator shall be located along at least a portion of the gap 24. This applies also to the perforations 32–35, 40,42. The bars 18, 19 and, respectively, 30, 37 of the rotor and stator 83 preferably extend substantially along the entire gap 24. The screen openings 32–35, 40,42 also are arranged preferably substantially along the entire gap 24.

The design with screen openings 32,34 in the bottom of the grooves 31 or 39, which are enclosed by the bars 30 or 37, is intended for higher rotation speeds, while the design with screen openings 33,35 on the top of the bars 30 or 37 is intended for lower numbers of revolution of the rotor 10. According to FIG. 6, the screen openings 40,42 are located on the sides of the bars 30. Such a design is suitable for all rotation speeds.

The axial position of the rotor and therewith the gap 24 between the rotor 10 and stator 83 are controlled at operation by a conventional hydraulic control valve 50, which is affected by the movement of the bearing housing 14 in axial direction. Such control devices are described, for example, in the patent specifications SE Nos. 183 750 and 214 707.

In operation, the pulp suspension is supplied by means of pump, or by gravity from overlying level box, through the feed pipe 74, whereby the pulp suspension is distributed about the inlet opening at the refining/screening devices 22,83. The refining and turbulence procedure at the passage of the suspension through the gap maintained between the rotor 10 and stator 83 is the same as in the case of usual refiners of conic or cylindric type.

Due to the generated high centrifugal forces (corresponding to acceleration 600–2500 g), which for example at a cone angle of rotor, stator of 15° are utilized to corresponding cos 15° (0.96593), i.e. to about 96% in perpendicular direction, coinciding with the direction of the perforations in the stator, very high pressure pulsations arise in the stator 83 with a frequency and size determined by the groove division of the rotor 10 and the number of revolutions used. At an inlet diameter of 800 mm and an outlet diameter of 1200 mm and at 1500 rpm, the centrifugal force in perpendicular direction to the stator corresponds to about 1000 g at the inlet and about 1500 g at the outlet diameter.

The pressure pulse density at a groove division of 8 mm at the inlet of the rotor is about 8 kcs, which together with the high pressure maximum for each pulse yields a very effective fluidization even at very high fibre concentrations.

Figure 7:
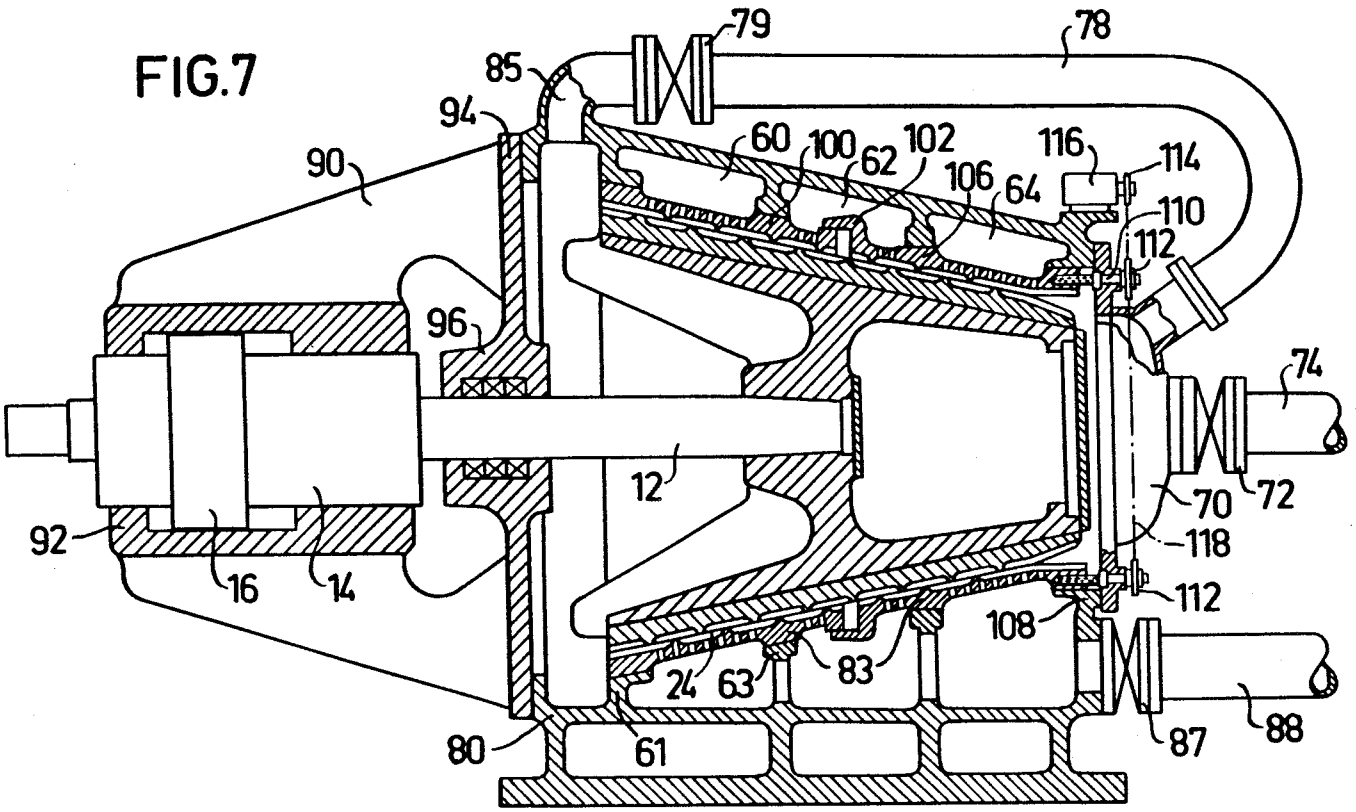
FIG. 7 is an axial cross-section of a different embodiment.

In FIG. 7 an alternative embodiment of the stator is shown, which renders it possible to adjust the gap width (24) separately at the inlet and outlet zone. This is achieved in that the stator 83 shown in FIG. 1 is divided into two parts 100 and 102, shown in FIG. 7, of which parts the part 100 is rigidly secured in the housing 80, while the part 102 is displaceably mounted in axial direction on the annular supports 106 and 108 connected to the housing 80.

The axial movement of the stator part 102 is controlled by threaded adjusting means 110 connected to the part 102, which means 110 are provided with sprockets 112, which by means of a chain 118 connected to the sprockets and driven by a shifting motor 116 via a sprocket 114 rotate the adjusting means until the desired position on the stator part 102 is achieved, which rotation is carried out simultaneously.

This arrangement renders it possible to separately adjust the gap width at the two stator parts 100 and 102, whereby the width at the stator part 100 is adjusted by means of the hydraulic piston 16 and its setting means 50, and the gap at the stator part 102 is adjusted by the adjusting means 116 to desired size equal to or different of the gap at the stator part 100. The two gap widths at 100 and 102 are adjusted thereafter, increased or reduced simultaneously, by the hydraulic adjusting means 16 and the means 50.

By this arrangement the combined intensity screening/refining can be varied between the two zones. The gap width at the inlet zone 102, for example, can be increased for obtaining predominantly screening effect, while the secondary zone is adjusted to a smaller gap width for increased refining effect, by means of which coarse fibre bundles, shives etc. not accepted in the primary zone are treated to a dimension rendering possible their passage through the screening perforated surface of the stator part to the accept flow from the apparatus.

It is, of course, also possible to divide the stator into more zones for separate adjustment of the gap width in each zone, but two zones are preferable.

The invention is not restricted to the embodiments shown, but can be varied within the scope of the invention idea.

I claim:

1. An apparatus for treating a fibre suspension comprising a housing having an inlet and an outlet, a rotor having an outer surface arranged within said housing, a first plurality of treating members arranged over the outer surface of said rotor, a stator having an inner surface surrounding said rotor within said housing, a second plurality of treating members arranged over the inner surface of said stator, the inner surface of said stator cooperating with the outer surface of said rotor to define a refining gap therebetween for the treatment of fibre suspension being supplied thereto by the cooperation of the first and second plurality of treating members, a portion of said stator including a plurality of screening apertures therein to permit the outward passage therethrough of at least a portion of the fibre suspension being treated within said refining gap for discharge from said apparatus through said outlet of said housing, said plurality of screening apertures being at least co-extensive with said first plurality of treating members arranged over the outer surface of said rotor, said refining gap providing a first treating zone having an inlet and a second treating zone having an outlet arranged along a portion of the length of said rotor, and adjusting means for adjusting the width of the refining gap within the first treating zone independently of the width of the refining gap within the second treating zone.

2. The apparatus of claim 1, wherein said stator includes a first member moveably mounted thereon for providing said first treating zone and a second member fixedly mounted thereon for providing said second treating zone.

3. The apparatus of claim 2, wherein said adjusting means is operatively coupled to said first member for the axial movement thereof within said housing to adjust the width of the refining gap within said first treating zone.

4. The apparatus of claim 2, further including moving means for the axial movement of said rotor within said housing to simultaneously adjust the width of the refining gap within said first treating zone and said second treating zone.

5. The apparatus of claim 2, wherein said first treating zone is contiguous with said second treating zone.

6. The apparatus of claim 1, further including recycle means for recycling fibre suspension from the outlet of said second treating zone to the inlet of said first treating zone.

7. The apparatus of claim 1, wherein said second plurality of treating members include a plurality of alternating bars and grooves for the treatment of the fibre suspension within said refining gap.

8. The apparatus of claim 7, wherein said screening apertures are arranged between said bars and in communication with said grooves.

9. The apparatus of claim 7, wherein said screening apertures are arranged extending through said bars and in communication with said refining gap.

10. The apparatus of claim 7, wherein said screening apertures are arranged extending through said bars at an angle to the longitudinal axis thereof and communicating with a portion of said refining gap between said bars.

11. The apparatus of claim 1, wherein said first plurality of treating members include a plurality of alternating bars and grooves for the treatment of the fibre suspension within said refining gap.

12. The apparatus of claim 7, further including an annular chamber arranged between said stator and said housing in fluid communication with the outlet thereof, and said plurality of screening apertures arranged within said stator providing fluid communication between said refining gap and said annular chamber, whereby that portion of the fibre suspension passing through said screening apertures are discharged through the outlet of said housing. outlet of said housing.

13. The apparatus of claim 1, further including rotating means for rotating said rotor within said housing.

14. An apparatus for treating a fibre suspension comprising a housing having an inlet and an outlet, a rotor rotatably arranged within said housing, a portion of the surface of said rotor including a plurality of treating members for mechanically treating the fibre suspension, a first stator surrounding a portion of said rotor within said housing, a second stator surrounding another portion of said rotor within said housing, a portion of said first and second stators including a plurality of screening apertures to permit the passage therethrough of at least a portion of the fibre suspension and a plurality of treating members for the mechanical treatment of said fibre suspension, said plurality of screening apertures being at least co-extensive with said plurality of treating members arranged on the surface of said rotor, the inner surfaces of said first and second stator and the outer surface of said rotor defining a refining gap therebetween for the treatment of the fibre suspension being supplied thereto through the inlet of said housing, said refining gap providing a first fibre suspension treating zone along a portion of the first stator and a second fibre suspension treating zone along a portion of said second stator, said first fibre suspension treating zone having an inlet and said second fibre suspension treating zone having an outlet, adjusting means for adjusting the width of the refining gap within the first fibre suspension treating zone independent of the width of the refining gap within the second fibre suspension treating zone by displacement of the first stator within said housing, recycle means for recycling fibre suspension from the outlet of said second fibre suspension treating zone to the inlet of said first fibre suspension treating zone, and an annular chamber arranged between said stator and said housing in fluid communication with the outlet thereof, said plurality of screening apertures in fluid communication between said refining gap and said annular chamber, whereby that portion of the fibre suspension passing through said screening apertures are discharged through the outlet of said housing.

15. The apparatus of claim 14, further including moving means for the axial movement of said rotor within said housing to simultaneously adjust the width of the refining gap within said first fibre suspension treating zone and said second fibre suspension treating zone.

* * * * *

UNITED STATES PATENT AND TRADEMARK OFFICE

CERTIFICATE OF CORRECTION

PATENT NO. : 4,955,549

DATED : September 11, 1990

INVENTOR(S) : Reinhall

It is certified that error appears in the above-identified patent and that said Letters Patent is hereby corrected as shown below:

Column 5, line 38, "7" should read --1--.

Column 5, lines 46-47, delete "outlet of said housing.", second occurrence.

Signed and Sealed this

Thirty-first Day of December, 1991

*Attest:*

HARRY F. MANBECK, JR.

*Attesting Officer*

*Commissioner of Patents and Trademarks*